US006401827B1

(12) United States Patent
Ferguson et al.

(10) Patent No.: US 6,401,827 B1
(45) Date of Patent: Jun. 11, 2002

(54) TUBING HANGER RUNNING TOOL

(75) Inventors: Bobby L. Ferguson, Friendswood; Jose A. Alvarado, Houston; Charles D. Bridges; Eugene A. Borak, Jr., both of Cypress; Vicki D. Corso, Richmond, all of TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 09/684,187

(22) Filed: Oct. 6, 2000

Related U.S. Application Data

(60) Provisional application No. 60/158,100, filed on Oct. 7, 1999.

(51) Int. Cl.[7] ..... E21B 23/08

(52) U.S. Cl. ..... 166/382; 166/120; 166/208; 166/212; 166/383

(58) Field of Search ..... 166/382, 383, 166/208, 212, 217, 120, 123, 182

(56) References Cited

U.S. PATENT DOCUMENTS

| | | | | |
|---|---|---|---|---|
| 4,634,152 A | | 1/1987 | Pettit | 285/39 |
| 4,674,576 A | | 6/1987 | Goris et al. | 166/382 |
| 4,811,784 A | | 3/1989 | Theiss | 166/208 |
| 4,903,776 A | | 2/1990 | Nobileau et al. | 166/382 |
| 4,928,769 A | | 5/1990 | Milberger et al. | 166/382 |
| 4,969,516 A | | 11/1990 | Henderson et al. | 166/182 |
| 5,249,629 A | | 10/1993 | Jennings | 166/348 |
| 5,372,201 A | | 12/1994 | Milberger | 166/382 |
| 5,456,321 A | * | 10/1995 | Shiach et al. | 166/382 |
| 5,655,606 A | | 8/1997 | Ferguson | 166/382 |
| 5,735,344 A | * | 4/1998 | Duncan | 166/75.14 |

* cited by examiner

*Primary Examiner*—David Bagnell
*Assistant Examiner*—Zakiya Walker
(74) *Attorney, Agent, or Firm*—Bracewell & Patterson, L.L.P.

(57) ABSTRACT

A running tool is used to install a tubing hanger without entangling the continuous control lines. The tubing hanger running tool is made up of a central mandrel, an outer housing, a setting member, and an actuator. The mandrel has a lower end for securing to a tubing hanger. The outer housing surrounds the mandrel and is connected to the setting member. The actuator moves the setting member axially with respect to the mandrel so that the setting member can set the lock element on the tubing hanger, securing the tubing hanger to the tubing head. The setting member has openings which allow the control lines from the tubing hanger to be fed through to the outside of the running tool so that they are not entangled during the placement of the tubing hanger.

19 Claims, 4 Drawing Sheets

TUBING HANGER RUNNING TOOL

This application claims the benefit of U.S. Provisional Application No. 60/158,100, filed Oct. 7, 1999.

BACKGROUND OF THE INVENTION

1. Field of the Invention

The present invention relates generally to wellhead and completion equipment. More specifically, the present invention relates to a tubing hanger running tool.

2. Description of the Related Art

When drilling for oil or gas typically a wellhead housing will be mounted at the upper end of the well to a large diameter string of conductor pipe. The well is then drilled deeper and a string of casing will be run. Subsequently, the well may be drilled to a deeper depth and another string of casing may be installed. Eventually production tubing will be installed.

Often the tubing hanger will provide for continuous control lines to control and gather data from downhole pumps, valves, or other equipment. The control lines secure to the upper and lowere ends of the tubing hanger. Passages through the tubing hanger connect the upper and lower ends Running tools are usually employed to lower and install tubing hangers in wellheads. The running tool is secured to the tubing hanger and lowered on a conduit. One type of tubing hanger rests on a permanent shoulder. While this simplifies the running tool mechanism it restricts the diameter of other tools that may pass the shoulder, effectively reducing the bore from that point.

Another type of tubing hanger has an annular locking member on its outer diameter that engages a profile in the wellhead. The locking member is moved axially by the running tool causing it to expand radially to engage the profile. The prior art running tools have an axially movable sleeve that slides over the tubing hanger to actuate the locking member. Often, to avoid entanglement with the running tool, control lines extending upward from the tubing hanger must be cut to accommodate the sleeve of the running tool. After the tubing hanger is installed these lines must be spliced This procedure is time consuming and the splices can fail.

BRIEF SUMMARY OF THE INVENTION

A running tool is used to install a full bore tubing hanger without entangling the continuous control lines. The tubing hanger running tool is made up of a central mandrel, an outer housing, a setting member, and an actuator. The mandrel has a lower end for securing to a tubing hanger. The outer housing surrounds the mandrel and is connected to the setting member. The actuator moves the setting member axially with respect to the mandrel so that the setting member can set the lock element on the tubing hanger, securing the tubing hanger to the tubing head. The setting member has openings which allow the control lines from the tubing hanger to be fed through to the outside of the running tool so that they are not entangled during the placement of the tubing hanger.

The setting member may be comprised of a plurality of arms circumferentially spaced to provide openings through which the continuous control lines can be fed. The arms have inwardly facing lugs on their lower end for engaging the lock element on the tubing hanger.

DETAILED DESCRIPTION OF THE PREFERRED EMBODIMENT

Figure 1:
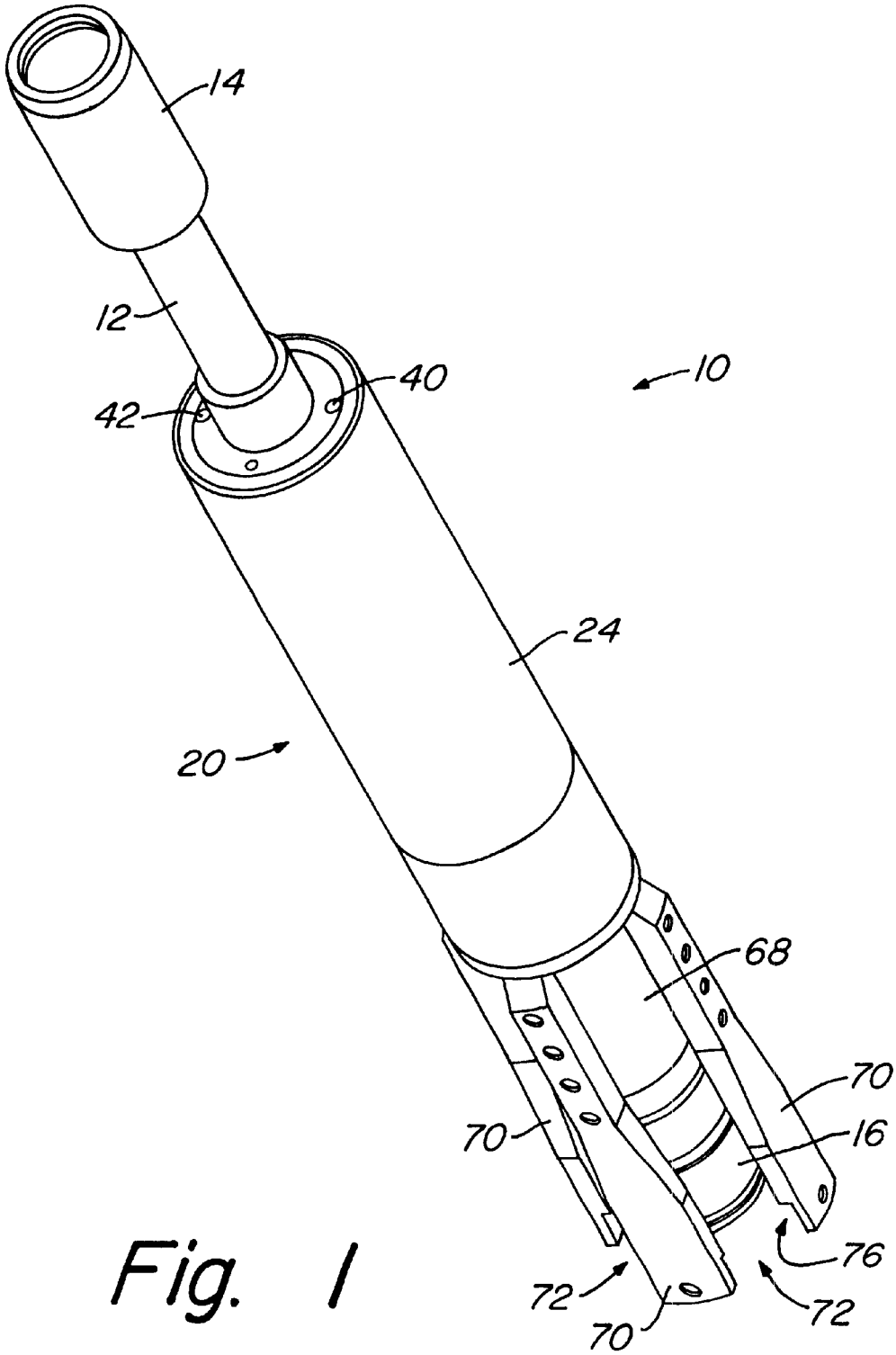
FIG. 1 is a perspective view of a running tool in accordance with this invention.
Figure 2:
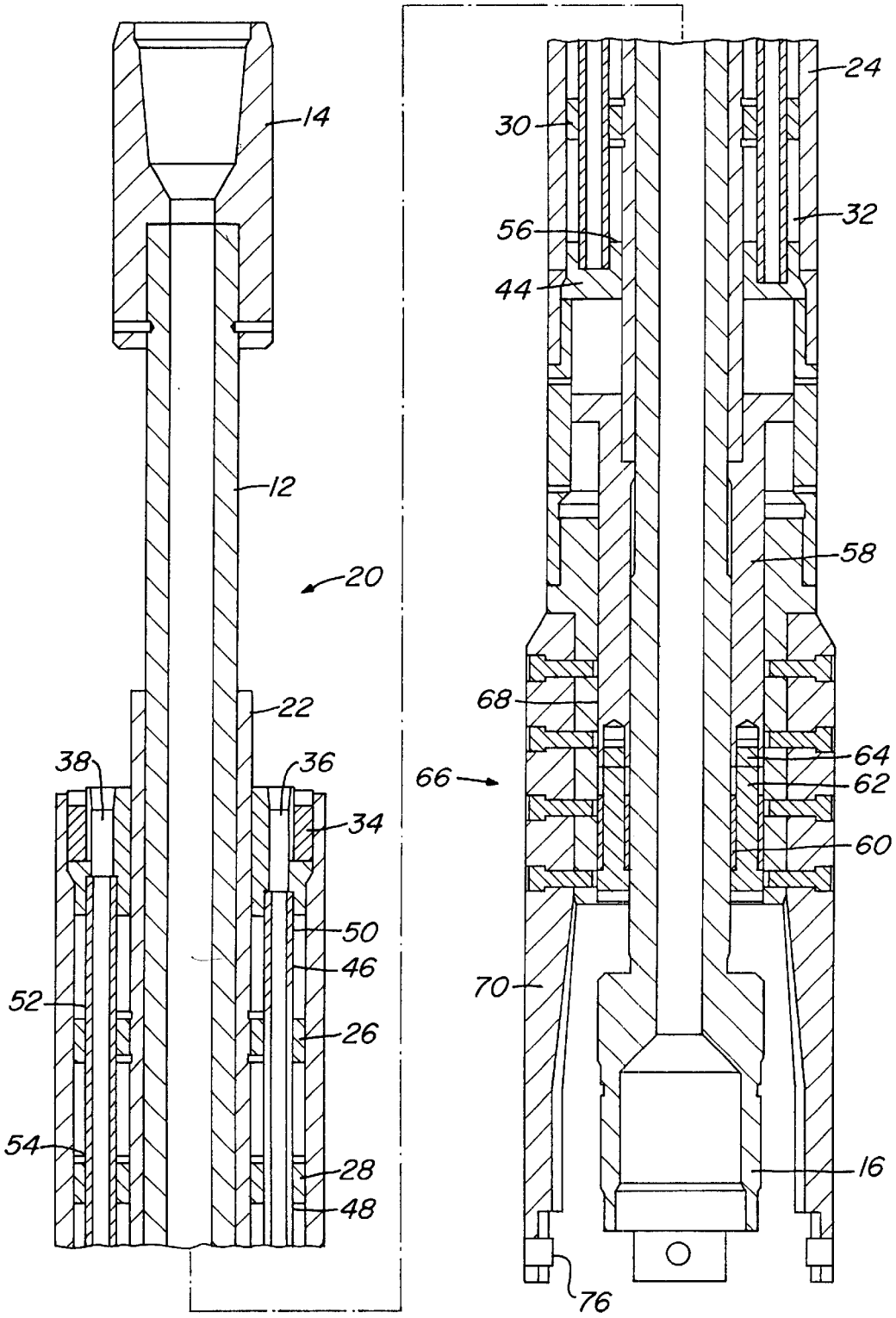
FIG. 2 is a sectional view of the running tool of FIG. 1.
Figure 3:
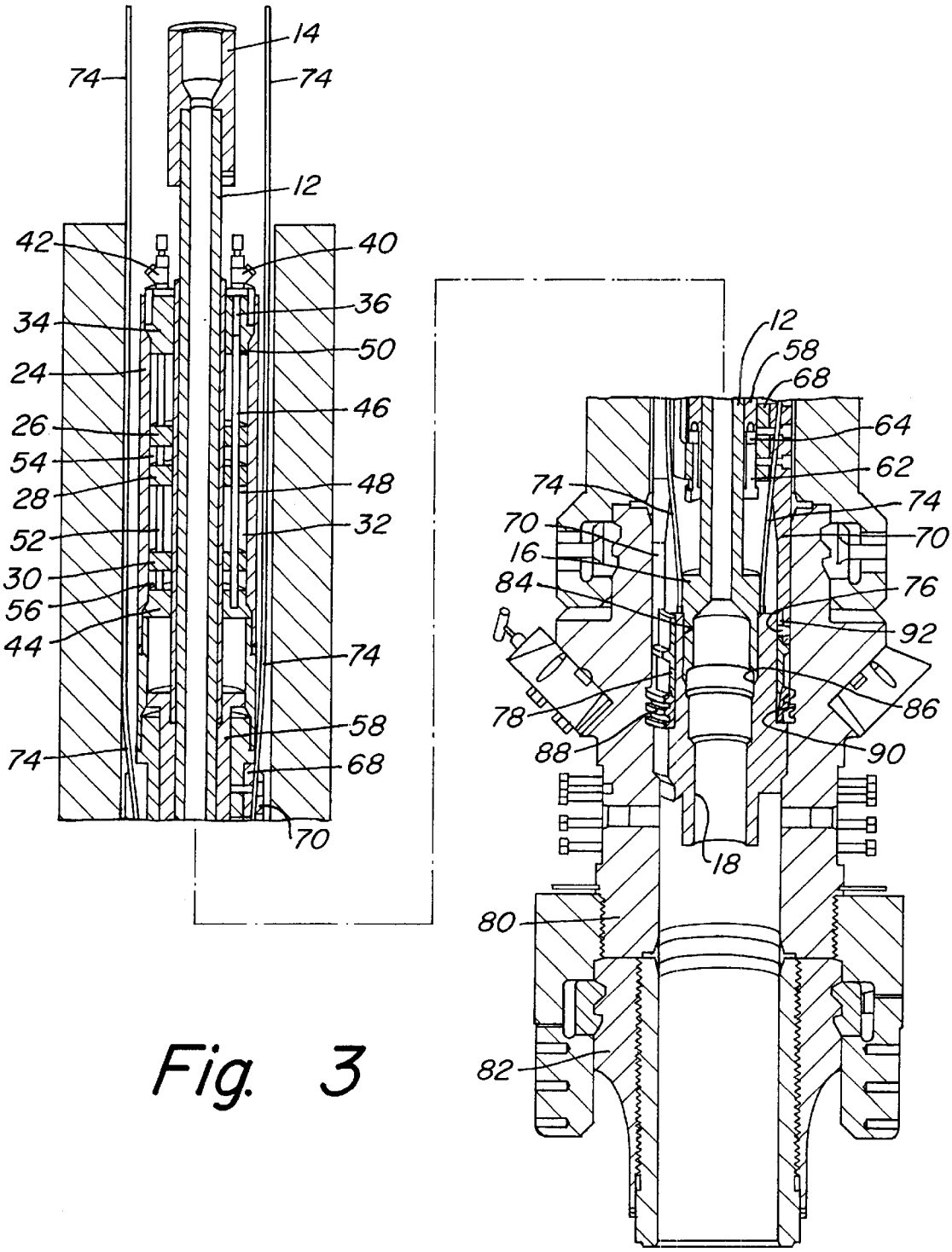
FIG. 3 is a sectional view of a well head and the running tool of FIG. 1, showing the running tool prior to setting the lock element.

Referring to FIGS. 1 and 2, running tool 10 is based on central mandrel 12. Central mandrel 12 has an adapter 14 at its upper end for connecting to running string (not shown) and lower end 16 is adapted for threadingly engaging tubing hanger 18 (FIG. 3). An actuator 20 is attached to mandrel 12. Actuator 20 of the preferred embodiment is made up of an inner cylinder 22, an outer housing 24 and a plurality of pistons 26,28,30. Inner cylinder 22 surrounds central mandrel 12 and has an outer surface and a lower end. Inner cylinder 22 is surrounded by outer housing 24. Outer housing 24 has an inner surface, an upper end, and a lower end. Outer housing 24 is spaced apart from inner cylinder 22 to create an annulus 32. Pistons 26, 28, 30 operate within annulus 32.

Pistons 26,28,30 are annular members axially spaced apart in annulus 32. Annular pistons 26, 28, 30 engage the outer surface of inner cylinder 22 and the inner surface of outer housing 24. Upper annular piston 26 and lower annular piston 30 are affixed to inner cylinder 22. Center annular piston 28 is affixed to outer housing 24.

An upper annulus cap 34 engages the outer surface of inner cylinder 22 and is attached to the upper end of outer housing 24. In the preferred embodiment, upper annulus cap 34 defines a first hydraulic chamber 36 and a second hydraulic chamber 38. First hydraulic chamber 36 has first hydraulic connector 40 at an upper end, and second hydraulic chamber 38 has second hydraulic connector 42 at an upper end. A lower annulus cap 44 engages the outer surface of inner cylinder 22 and is attached to outer housing 24 near its lower end.

Pressure tubes 46, 52 extend from upper annulus cap 34 to lower annulus cap 44, passing through apertures in annular pistons 26,28,30. First pressure tube 46 extends into annulus 32 from first hydraulic chamber 36. First pressure tube 46 has a lower port 48 between center annular piston 28 and lower annular piston 30 and an upper port 50 between upper annular piston 26 and upper annulus cap 34. Second pressure tube 52 extends into annulus 32 from second hydraulic chamber 38. Second pressure tube 52 has an upper port 54 between center annular piston 28 and upper annular piston 26 and a lower port 56 between lower annular piston 30 and lower annulus cap 44.

In the preferred embodiment, inner cylinder 22 is threadingly attached to central mandrel 12 through an inner cylinder extension 58 and a floating nut 60. Inner cylinder extension 58 has an interior surface in sliding engagement with central mandrel 12. The upper end of inner cylinder extension 58 is affixed to the lower end of inner cylinder 22. The lower end of inner cylinder extension 58 receives longitudinal screw 62. Floating nut 60 and floating nut spacer 64 surround longitudinal screw 62. Floating nut 60 is threadingly engaged with central mandrel 12.

In the preferred embodiment outer housing 24 is connected to a setting member 66 made up of an arm base 68 and arms 70. Arm base 68 is affixed to the lower end of outer housing 24 and is slidably engaged by inner cylinder extension 58. Arms 70 each have an upper end attached to arm base 68. Arms 70 are spaced circumferentially from each other to provide openings 72 through which control lines 74 (FIG. 3) may be fed. An inwardly facing lug 76 is on the lower end of each arm 70 for engaging lock element 78 on tubing hanger 18 (FIG. 3).

Figure 4:
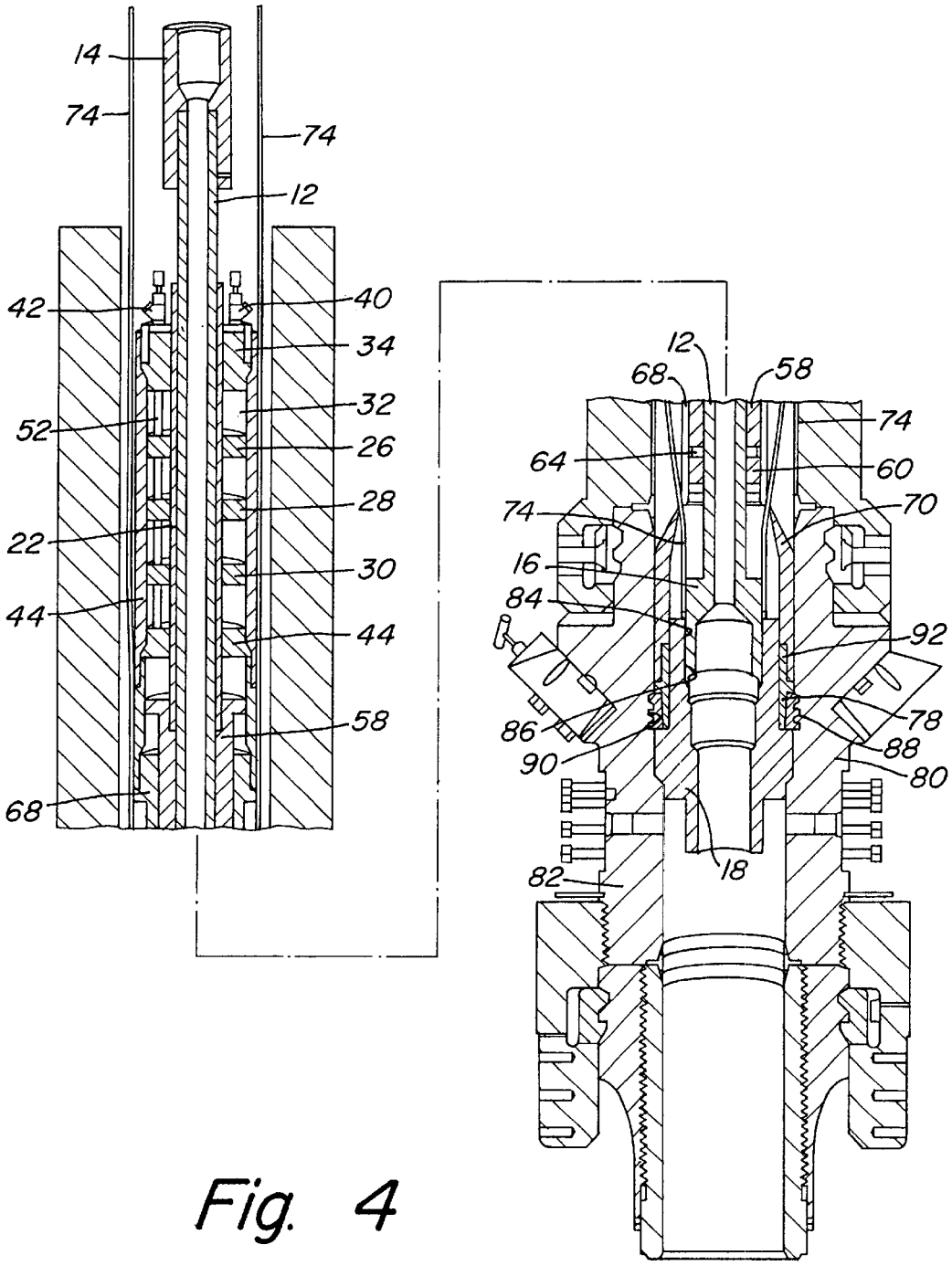
FIG. 4 is a sectional view of a well head and the running tool of FIG. 1, showing the running tool after setting the lock element.

As shown in FIGS. 3 and 4, the preferred embodiment of running tool 10 is used to install tubing hanger 18 in a well with tubing head 80 affixed to upper end of wellhead 82. tubing hanger 18 has a receptacle 84 with an interior profile or threads 86. A split locking ring 88 is carried on the exterior of tubing hanger 18. Lock element 78 is axially slidable and located above ring 88. When in a lower position, lock element 78 forces ring 88 outwards into receiving profile 90 in tubing head 80. This secures tubing hanger 18 to tubing head 80. Lock element 78 has exterior J-slots 92 for receiving lugs 76 of arms 70.

The preferred embodiment is operated by first rotating central mandrel 12 relative to inner cylinder 22, causing mandrel 12 to retract, or move upward, relative to inner cylinder 22. Then pressure is provided to first pressure tube 46 through first hydraulic connector 40 and first hydraulic chamber 36. This increases the pressure in annulus 32 between center annular piston 28 and lower annular piston 30, as well as annulus 32 between upper annular piston 26 and upper annulus cap 34, thus retracting, or moving, outer housing 24 upward relative to inner cylinder 22.

With both outer housing 24 and central mandrel 12 retracted, running tool 10 is positioned over tubing hanger 18. Control lines 74 are then fed through openings 72 between arms 70 of running tool 10 and up along the outside of outer housing 24. Once the control lines 74 are fed, running tool 10 is lowered onto tubing hanger 18 so that inwardly facing lugs 76 on the lower end of arms 70 engage J-slots 92 on lock element 78. Central mandrel 12 is then rotated so that it screws down through floating nut 60 and threads into receptacle 84 in tubing hanger 18, thus making up central mandrel 12 to tubing hanger 18 without entangling control lines 74.

The upper end adapter 14 of central mandrel 12 is connected to a running string (not shown). The operator then lowers the running string until tubing hanger 18 is landed in tubing head 80 as shown in FIG. 3. Second pressure tube 52 is then pressurized through second hydraulic connector 42 and second hydraulic chamber 38. This increases the pressure in annulus 32 between center annular piston 28 and upper annular piston 26 as well as between lower annular piston 30 and lower annulus cap 44, thus extending outer housing 24 and attached arms 70 downward. As pressure is increased, arms 70 press lock element 78 into ring 88, wedging ring 88 outward into receiving profile 90 in tubing head 80. This secures tubing hanger 18 in tubing head 80 as shown in FIG. 4.

To disengage running tool 10 from tubing hanger 18, central mandrel 12 is rotated, thus un-threading it from tubing hanger receptacle 84. The rotation will also disengage lugs 76 from the lower portion of J-slots 92 so that running tool 10 can be lifted out. Importantly, arms 70 will not rotate beyond what is required to disengage lugs 76 from J-slots 92, so control lines 74 will not be entangled. Running tool 10 can then be retrieved.

The running tool 10 described above allows a tubing hanger 18 with control lines 74 to be placed into a tubing head 80 without using a permanent load shoulder or requiring splices in the control lines 74. This prevents unneeded restriction on the bore of the drilling operation while also providing more reliable, splice free, control lines 74.

While the invention has been shown in only one of its forms, it should be apparent to those skilled in the art that it is not so limited, but is susceptible to various changes without departing from the scope of the invention.

We claim:

1. A running tool for a well pipe hanger having an engaging profile, an exterior lock element for locking the hanger within a tubular wellhead member, and at least one control line extending upward therefrom, the running tool comprising:

a central mandrel with a lower end for securing to the engaging profile of the pipe hanger;

an outer housing having a setting member on a lower end for engaging the lock element, the setting member defining at least one circumferentially extending opening on a lateral exterior portion of the setting member to feed the at least one control line through the opening along the outside of the outer housing; and an actuator to move the setting member axially relative to mandrel to move the lock element on the pipe hanger into engagement with the wellhead member.

2. The running tool of claim 1 wherein:

the lower end of the central mandrel is threaded.

3. The running tool of claim 1 wherein:

said at least one circumferentially extending opening comprises a plurality of circumferentially spaced openings spaced around the setting member.

4. The running tool of claim 1 wherein:

the setting member is comprised of a plurality of circumferentially spaced arms extending downwardly from the outer housing, and said opening comprises a plurality of openings, each being formed between two of the arms.

5. The running tool of claim 4 wherein:

the arms are equipped with inwardly facing lugs to engage the lock element.

6. The running tool of claim 1 wherein the engaging profile in the pipe hanger comprises a threaded receptacle, the running tool further comprising:

a threaded nut connected with the housing and threadingly engaging the mandrel, enabling the lower end of the mandrel to be rotated to engage threads in the receptacle of the pipe hanger while the housing remains stationary.

7. A running tool for a well pipe hanger having a receptacle, an exterior lock element for locking the hanger within a tubular wellhead member, and at least one control line extending upward therefrom, the running tool comprising:

a central mandrel with a lower end for securing to the receptacle in the pipe hanger;

an outer housing having a setting member on a lower end for engaging the lock element, the setting member defining at least one circumferentially extending opening to feed the at least one control line along the outside of the outer housing;

an actuator to move the setting member axially relative to mandrel to move the lock element on the pipe hanger into engagement with the wellhead member; and wherein the actuator comprises:

an upper annular piston engaging an inner surface of the outer housing and affixed to an inner cylinder;

a center annular piston engaging an outer surface of the inner cylinder and affixed to the outer housing; and a lower annular piston engaging the inner surface of the outer housing and affixed to the inner cylinder.

8. The running tool of claim 7 further comprising:

a first pressure tube extending into an annulus between the inner cylinder and the outer housing with a port between the center annular piston and the lower annular piston;

a second pressure tube extending into the annulus between the inner cylinder and the outer housing with a port between the center annular piston and the upper annular piston; and wherein each of the pressure tubes are adapted to be connected to a source of hydraulic pressure.

9. The running tool of claim 8 wherein:

the annular pistons each have a first aperture and a second aperture; and the first pressure tube extends through the first aperture in each of the annular pistons and the second pressure tube extends through the second aperture in each of the annular pistons.

10. The running tool of claim 7 further comprising:

an upper annulus cap engaging the outer surface of the inner cylinder and attached to the upper end of the outer housing;

a lower annulus cap engaging the outer surface of the inner cylinder and attached to the outer housing near its lower end;

a first pressure tube extending into the annulus with a lower port between the center annular piston and the lower annular piston and an upper port between the upper annular piston and upper annulus cap; and a second pressure tube extending into the annulus with an upper port between the center piston and the upper piston and a lower port between the lower piston and the lower annulus cap.

11. A running tool for a well pipe hanger having a receptacle, an exterior lock element for locking the hanger within a tubular wellhead member, and a plurality of control lines extending upward therefrom, the running tool comprising:

a central mandrel with a lower end adapted for securing to a receptacle in a pipe hanger;

an inner cylinder threadingly connected to the central mandrel;

an outer housing surrounding the inner cylinder to create an annulus;

a plurality of downward extending arms depending from the outer housing and spaced to create openings for feeding the control lines along the exterior of the outer housing, each of the arms engaging the lock member; and at least one piston positioned between the inner cylinder and the outer housing to move the outer housing and the arms relative to the central mandrel to move the lock member into engagement with the wellhead member.

12. The running tool of claim 11 wherein:

the central mandrel has an upper end threaded for connecting to a running string.

13. The running tool of claim 11 wherein:

the lower end of the central mandrel is threaded.

14. The running tool of claim 11 further comprising:

inwardly facing lugs near a lower end of each of the arms for engaging the lock element.

15. The running tool of claim 11 wherein said at least one piston comprises:

an annular member engaging an outer surface of the inner cylinder and an inner surface of the outer housing.

16. The running tool of claim 11 wherein said at least one piston comprises:

an upper annular piston engaging an inner surface of the outer housing and affixed to the inner cylinder;

a center annular piston engaging an outer surface of the inner cylinder and affixed to the outer housing; and a lower annular piston engaging the inner surface of the outer housing and affixed to the inner cylinder.

17. The running tool of claim 16 further comprising:

an upper annulus cap engaging the outer surface of the inner cylinder and attached to the upper end of the outer housing;

a lower annulus cap engaging the outer surface of the inner cylinder and attached to the outer housing near its lower end;

a first pressure tube extending into the annulus with a lower port between the center annular piston and the lower annular piston and an upper port between the upper annular piston and upper annulus cap;

a second pressure tube extending into the annulus with an upper port between the center piston and the upper piston and a lower port between the lower piston and the lower annulus cap; and each of the pressure tubes adapted to communicate with a source of pressurized hydraulic fluid.

18. A method for running a well pipe hanger having a receptacle, an exterior lock element for locking the hanger within a tubular wellhead member, and at least one control line extending upward therefrom, comprising:

providing a running tool with a central mandrel and outer housing with a setting member, the setting member having at least one circumferentially extending opening;

feeding the at least one control line through the opening and up along the exterior of the outer housing;

engaging a lower end of the setting member with the locking element of the pipe hanger;

securing a lower end of the central mandrel to the receptacle in the pipe hanger;

landing the pipe hanger into the wellhead member; and moving the mandrel and the outer housing axially relative to each other, causing the setting member to move the locking element into engagement with the wellhead.

19. The method of claim 18 wherein:

the step of moving the mandrel and the setting member axially comprises applying hydraulic pressure to the running tool.

* * * * *